US009865111B2

(12) United States Patent
Hermann et al.

(10) Patent No.: US 9,865,111 B2
(45) Date of Patent: Jan. 9, 2018

(54) FOB CASE FOR REDUCED TRANSMISSION INTERFERENCE

(71) Applicant: Ford Global Technologies, LLC, Dearborn, MI (US)

(72) Inventors: Thomas Joseph Hermann, Troy, MI (US); Tye Arthur Winkel, Canton, MI (US); John Locke, Rochester, MI (US); Lawrence Banasky, Jr., Livonia, MI (US); Mark Wisnewski, Stockbridge, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 255 days.

(21) Appl. No.: 14/672,544

(22) Filed: Mar. 30, 2015

(65) Prior Publication Data

US 2016/0294049 A1 Oct. 6, 2016

(51) Int. Cl.

| | |
|---|---|
| ***H01Q 1/12*** | (2006.01) |
| ***G07C 9/00*** | (2006.01) |
| ***H01H 9/02*** | (2006.01) |
| ***H01Q 1/32*** | (2006.01) |

(52) U.S. Cl.

CPC ..... *G07C 9/00309* (2013.01); *H01H 9/0235* (2013.01); *H01Q 1/3241* (2013.01); *G07C 9/00944* (2013.01); *G07C 2009/00984* (2013.01)

(58) Field of Classification Search

CPC ..... H01Q 1/32; H04W 12/12
USPC ..... 343/878
See application file for complete search history.

(56) References Cited

U.S. PATENT DOCUMENTS

| | | | | |
|---|---|---|---|---|
| 5,281,970 | A | 1/1994 | Blaese | |
| 6,127,740 | A | 10/2000 | Roddy et al. | |
| 6,230,031 | B1 | 5/2001 | Barber | |
| 6,281,599 | B1 | 8/2001 | Murakamig | |
| 6,545,629 | B1 * | 4/2003 | Johnson | B60R 25/24 200/9 |
| 6,597,897 | B2 | 7/2003 | Tang et al. | |
| 7,034,238 | B2 * | 4/2006 | Uleski | G05G 1/02 200/341 |
| 7,545,259 | B2 * | 6/2009 | Luo | G01C 21/20 340/426.13 |
| 7,724,125 | B2 | 5/2010 | Ghabra et al. | |
| 7,933,324 | B2 | 4/2011 | Ghabra et al. | |
| 7,944,340 | B1 | 5/2011 | Ghabra et al. | |

(Continued)

FOREIGN PATENT DOCUMENTS

JP 3314989 B2 8/2002

OTHER PUBLICATIONS

Delphi key fob could provide 1-km range, SAE International, Apr. 27, 2010 (2 pages).

(Continued)

*Primary Examiner* — Huedung Mancuso
(74) *Attorney, Agent, or Firm* — Frank A. MacKenzie; Bejin Bieneman PLC

(57) ABSTRACT

A fob includes a case, an antenna, at least one input device, and a positioning element. The case has an interface portion and a handle portion. The antenna is disposed at the interface portion of the case. The input device is disposed on the interface portion of the case. The finger positioner orients a user's hand on the handle portion of the case away from the antenna.

19 Claims, 9 Drawing Sheets

(56) References Cited

U.S. PATENT DOCUMENTS

| | | | | |
|---|---|---|---|---|
| 8,270,914 | B2 | 9/2012 | Pascolini et al. | |
| 8,847,731 | B2 | 9/2014 | Tieman | |
| 9,002,278 | B2 | 4/2015 | Anderson | |
| 9,203,463 | B2 | 12/2015 | Asrani et al. | |
| 9,369,163 | B2 | 6/2016 | Chen | |
| 9,380,540 | B1 | 6/2016 | Hermann et al. | |
| 9,478,088 | B2 | 10/2016 | Lee | |
| 9,499,125 | B2 | 11/2016 | Akay et al. | |
| 2002/0028663 | A1 | 3/2002 | Tang | |
| 2002/0180650 | A1 | 12/2002 | Pankinaho et al. | |
| 2003/0197640 | A9* | 10/2003 | Johnson | B60R 25/33 342/357.75 |
| 2004/0160352 | A1 | 8/2004 | Shimizu et al. | |
| 2004/0263316 | A1* | 12/2004 | Dix | B60R 25/04 340/5.23 |
| 2005/0242923 | A1 | 11/2005 | Pearson | |
| 2006/0132360 | A1 | 6/2006 | Caimi et al. | |
| 2006/0281423 | A1* | 12/2006 | Caimi | H01Q 9/045 455/129 |
| 2007/0093219 | A1 | 4/2007 | Nakasato | |
| 2009/0182587 | A1* | 7/2009 | Lewis | G01S 19/42 705/4 |
| 2009/0243796 | A1 | 10/2009 | Tieman | |
| 2009/0289860 | A1 | 11/2009 | Lee et al. | |
| 2010/0060544 | A1* | 3/2010 | Penev | H01Q 1/38 343/876 |
| 2011/0014879 | A1* | 1/2011 | Alberth | H01Q 1/242 455/75 |
| 2011/0049249 | A1* | 3/2011 | Kato | G06K 19/07749 235/492 |
| 2012/0071203 | A1 | 3/2012 | Wong | |
| 2012/0329524 | A1 | 12/2012 | Kent | |
| 2013/0016024 | A1* | 1/2013 | Shi | H01Q 1/243 343/833 |
| 2013/0109375 | A1* | 5/2013 | Zeiler | H04W 4/028 455/426.1 |
| 2013/0157586 | A1* | 6/2013 | Saito | H04B 7/0814 455/73 |
| 2014/0125535 | A1 | 5/2014 | Ramachandran et al. | |
| 2014/0176304 | A1 | 6/2014 | Park | |
| 2014/0240125 | A1* | 8/2014 | Burch | G08B 21/0213 340/539.13 |
| 2015/0116078 | A1 | 4/2015 | Mishra | |
| 2015/0120151 | A1 | 4/2015 | Akay et al. | |
| 2015/0178532 | A1 | 6/2015 | Brule | |
| 2017/0019134 | A1 | 1/2017 | Zhou et al. | |

OTHER PUBLICATIONS

Notice of Allowance dated May 5, 2017; U.S. Appl. No. 14/862,186; 27 pages.

GB Search Report 16002P, Appl No. GB1616037.6, dated Feb. 28, 2017; 4 pages.

* cited by examiner

FOB CASE FOR REDUCED TRANSMISSION INTERFERENCE

CROSS-REFERENCE TO RELATED APPLICATIONS

This application is related to U.S. patent application Ser. No. 14/672,521 filed Mar. 30, 2015 entitled "KEY FOB TRANSMISSION COMPENSATION and U.S. patent application Ser. No. 14/672,534, filed Mar. 30, 2015 entitled "KEY FOB TRANSMISSION COMPENSATION", the complete contents of which are hereby incorporated herein by reference in their entirety.

BACKGROUND

A remote keyless entry system (RKE system) includes a remote device, sometimes called a fob or key fob, used by the vehicle occupant in communication with a base unit embedded in a vehicle. The RKE system's range, i.e., the distance between the fob operated by the vehicle operator and the base unit, is a characteristic of perceived system quality. The system's range varies according to the fob's radio frequency (RF) output power, which is limited by federal regulation.

DESCRIPTION

Introduction

The output power level is defined and regulated in the US by the Federal Communication Commission (FCC). The fob's regulated power level is measured in "free space" without a human hand touching or proximate the fob. A human hand proximate an antenna in the fob may interfere with transmission and reduce the RF output power. Reduced output power reduces the RKE system's range, potentially resulting in operator dissatisfaction. An example fob that prevents interference caused by a user's hand that could reduce output power may include a case, an antenna, at least one input device, and a hand positioning element. The case has an interface portion and a handle portion. The antenna and input device are each disposed on the interface portion of the case. At least one hand positioning element may be included on the interface portion and/or the handle portion and orients a user's hand on the handle portion of the case and away from the antenna. Therefore, the user's hand is not as likely to reduce the RKE system's range.

Figure 1:
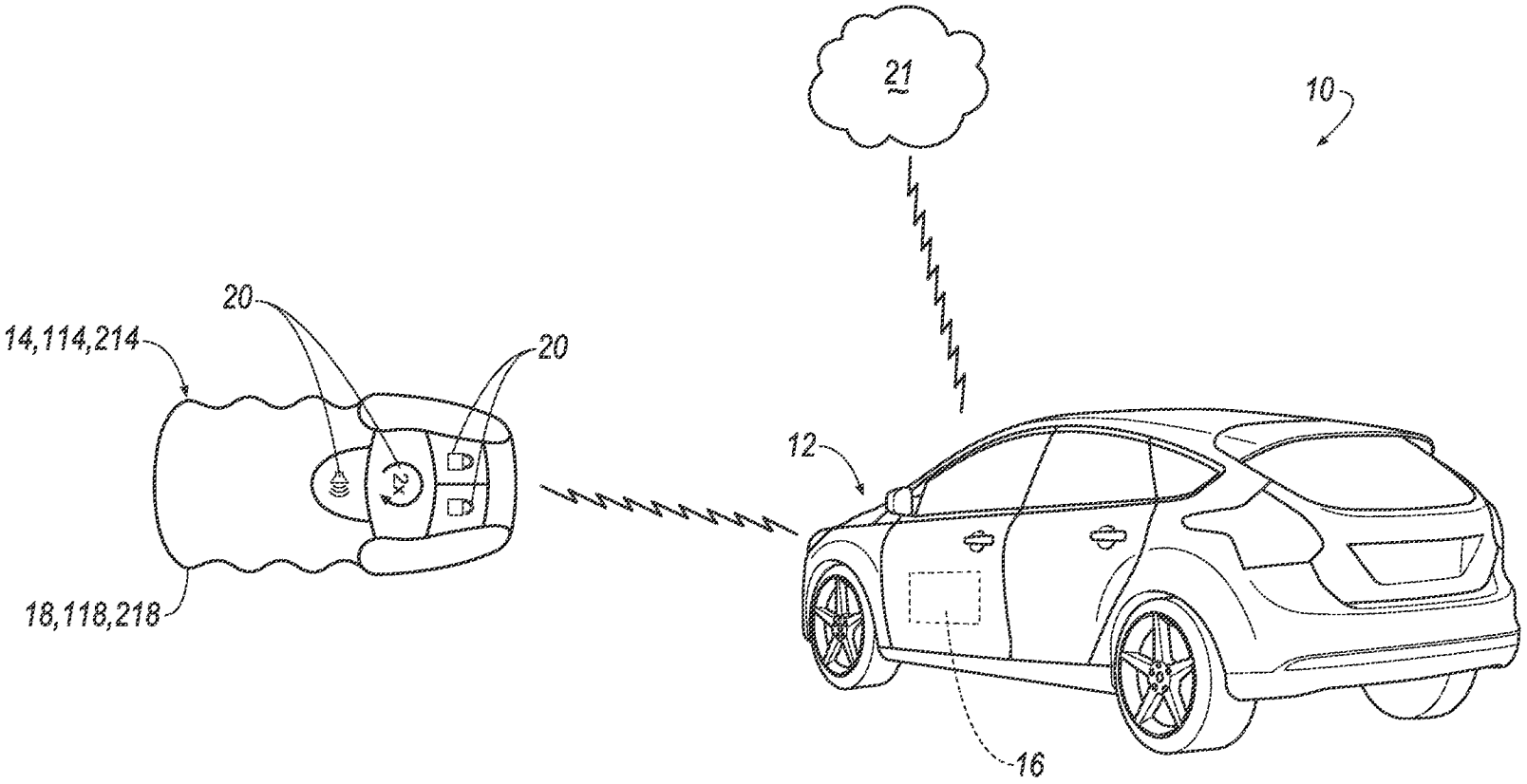
FIG. 1 is diagram of an example remote keyless entry system, including an example fob.
Figure 2:
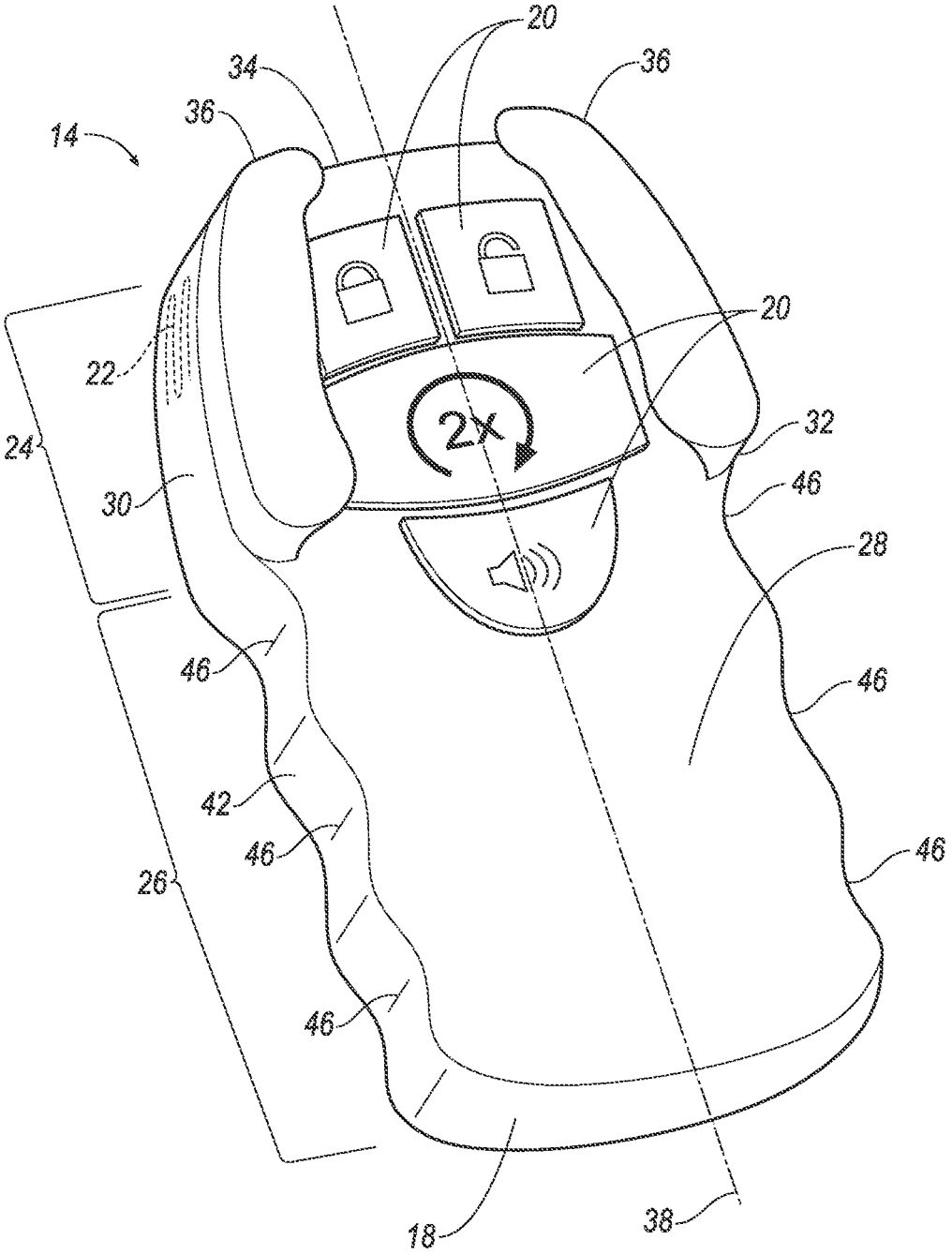
FIG. 2 is a perspective view of an example fob for the system of FIG. 1, including positioning elements for directing a position of a hand holding the fob.

FIG. 1 illustrates an example of a remote keyless entry (RKE) system 10 for a vehicle 12. The RKE system 10 provides for remote control from a fob 14 for various vehicle 12 applications such as door locks, trunk latch, interior and exterior lights, engine start, climate control, etc. The vehicle 12 is generally a land-based vehicle having two or more wheels, e.g., a passenger car, light truck, a motorcycle, etc. The vehicle 12 includes a base station 16 for receiving messages from the fob 14 and optionally transmitting messages to the fob 14.

The fob 14 transmits messages to the base station 16 and may also receive messages from the base station 16. Communications between the fob 14 and the base station 16 are typically radio frequency (RF) communications. The fob 14 includes a case 18 and at least one input device 20 for receiving inputs from an operator.

The fob 14 includes one or more antennas 22 (FIGS. 3A-3C) to transmit an RF signal from the fob 14 to the vehicle 12. In order to reduce the likelihood and amount of attenuation of output power due to a hand proximate the transceiver antenna 22, the fob 14 includes one or more hand positioning elements to direct a position of the hand holding the fob 14 during operation.

As described in detail below, the one or more hand positioning elements may direct an operator using to fob 14 to hold the fob 14 in a directed orientation. The one or more hand positioning elements may include finger positioners, finger slots, ridges, a hood, a tapered handle shape, etc. disposed on the fob 14 case 18 to direct an orientation of a hand holding the fob. The directed orientation as used herein is a position of the hand of the operator on the fob 14 that allows operation of the fob 14 with reduced or minimal interference between the hand of the operator and a transceiver antenna 22 used for a radio frequency transmission.

System Elements

An example of a fob 14 is shown FIGS. 2 and 3A-3D. The fob 14 includes a case 18. The case may be generally in the form of a rounded, rectangular box, forming an internal cavity enclosing an electronic module (not shown) for facilitating radio frequency (RF) communications. The case 18 includes an interface portion 24 and a handle portion 26 and has a top surface 28. The case 18 may, for example, be formed of a hardened plastic or other non-conductive material.

The interface portion 24 includes left lateral side 30, right lateral side 32, and a front end 34. At least one antenna 22 is disposed on the interface portion 22. The at least one antenna 22 may be, for example, a component included in the electronic module, and enclosed in the case 18. Additionally or alternatively, the antenna 22 may be a wire embedded within, e.g., the left lateral side 30, the right lateral side 32, and/or the front end 34. The antenna 22 may be embedded within the case 18 near an inside surface, an outside surface, and/or in between the inside and outside surfaces. In order to reduce radio frequency coupling between the antenna 22 and a hand operating the fob 14, the antenna 22 may be located in a position spaced away from the handle portion 26 of the fob 14. For example, the antenna 22 may be located in the front end 34, or in the left or right lateral sides 30, 32, proximate the front end 34.

As discussed above, the fob 14 includes one or more input devices 20 disposed on the top surface 28. The input devices 20 may be buttons, a touch screen display, a gesture sensing device, etc., for receiving input from an operator.

As further shown in FIGS. 2 and 3A-3D, the interface portion 24 may include ridges 36 along the left and right lateral sides 30, 32. In one orientation, as shown in FIGS. 2 and 3A-3C, the ridges 36 may extend upward from the left and right lateral sides 30, 32 above a level of the top surface 28 and inward towards a center axis 38 of the fob 14. According to this arrangement, the ridges 36 form respective barriers to accessing the input devices 20 from the left and right lateral sides 30, 32. An inside surface 40 of each ridge 36 may define, together with the top surface 28 of the fob 14, a partial cavity 39. Each partial cavity 39 is open towards the center axis 38 of the fob 14, and may be dimensioned, for example, such that the width of a $95^{th}$ percentile human thumb may fit within the cavity 39.

The ridges 36 may be formed as a single unit with the case 18 or a section of the case 18. For example, the ridges 36 and the case 18 or a section of the case 18 may be molded as a unitary structure. Alternatively, the ridges 36 may be formed independently and attached, for example, with adhesive, e.g., on the top surface 28 along the left and right lateral sides 30, 32 or one or more fasteners connecting the top surface 28 to the left and right lateral sides 30, 32.

As further shown in FIGS. 2 and 3A-3D, the case 18 includes a handle portion 26. The handle portion 26 extends from a side of the interface portion 24 opposite the front end 34 in the direction of the center axis 38 and has left and right lateral sides 42, 44.

In order to direct an orientation of a hand holding the fob 14 to the directed orientation, the handle portion 26 may include one or more finger positioners 46. The finger positioners 46 may, for example, be one or more grooves formed in each of the left and right lateral sides 42, 44. The grooves may have a shape that corresponds to a shape of at least a portion of a human finger, e.g., an inside (palm side) of the finger. In the case that there is more than one finger positioner 46, the finger positioners 46 may be arranged adjacently, with a spacing corresponding to the spacing of fingers on a human hand.

Figure 3A:
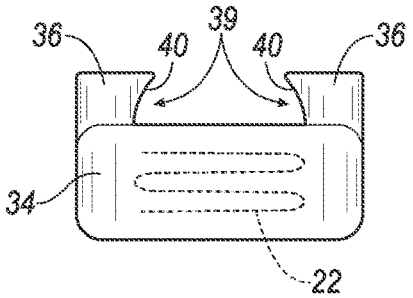
FIG. 3A is a front end view of the fob of FIG. 2.
Figure 3B:
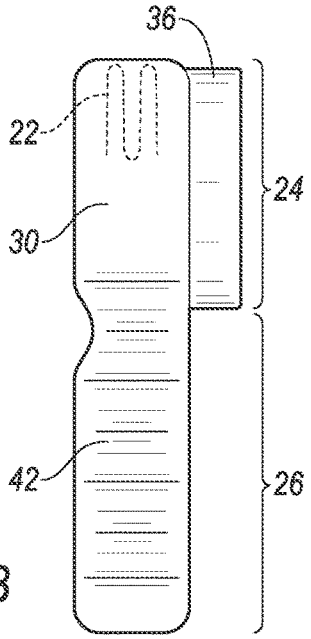
FIG. 3B is a left side view of the fob of FIG. 2.
Figure 3C:
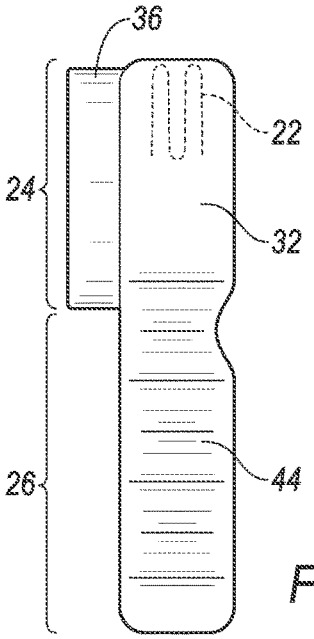
FIG. 3C is a right side view of the fob of FIG. 2.
Figure 3D:
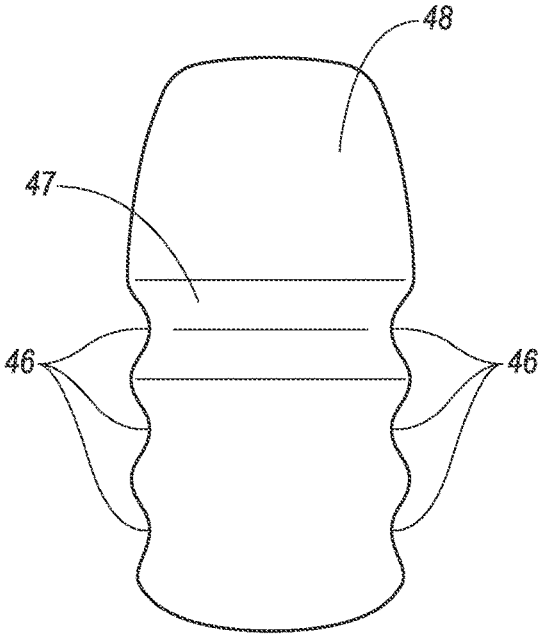
FIG. 3D is a bottom view of the fob of FIG. 2.

The fob case 18 includes a bottom surface 48. As shown in FIG. 3D, the bottom surface 48 may define a finger slot 47. The finger slot 47 on the bottom surface 48 of the handle portion 26 may be a groove formed in the bottom surface 48. The finger positioning slot 47 on the bottom surface 48 may be aligned, e.g., with one of the finger positioners 46 formed in the left and right lateral sides 40, 42. In the case where there is more than one finger positioner element 46 formed in the left and right lateral sides 42, 44, the finger slot 47 in the back surface 48 may be aligned with the finger positioner 46 nearest the interface portion 24. This position corresponds to a position of an index finger holding the fob 14 in the directed orientation. In the directed orientation, the other fingers of the hand of the operator holding the fob 14 are placed on the handle portion 26 on a side of the finger slot 47 opposite the interface portion 24, and therefore away from an antenna 22 disposed on the interface portion 24.

Figure 4:
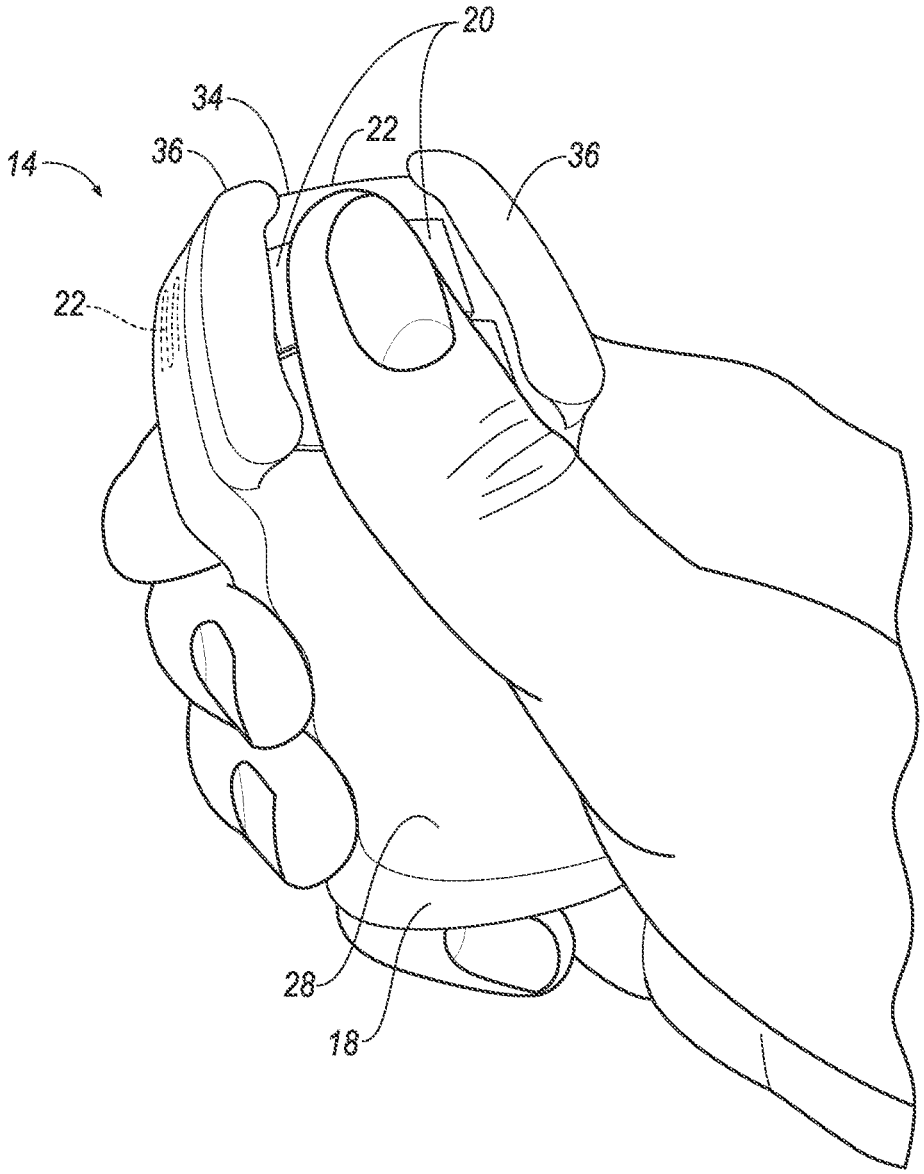
FIG. 4 is a perspective view of a hand holding the fob of FIG. 2.

FIG. 4 illustrates the example fob 14 of FIGS. 2 and 3A-3D, being held in the directed orientation. The fingers are directed to hold the fob 14 at the handle portion 26 by the finger positioners 46. The index finger of the hand is directed to the finger slot 47 on the bottom surface 48 (FIG. 3D).

The ridges 36 also direct the operator to hold the fob 14 in the directed orientation. The ridges 36 prevent, or render difficult or inconvenient, accessing the input devices 20, e.g., buttons, from the left or right lateral sides 30, 32. The shape and position of the ridges 36 directs access to the input device 20 by a thumb extending from the handle portion 26 towards the interface portion 24.

As one example, the ridges 36, according to their shape as shown in FIG. 4, may limit an extension of a thumb of a hand towards the front end 34 of the fob 14. The antenna 22, may, for example, be located in the front end 34 of the fob 14, as shown in FIG. 3A. According to this configuration, when the fob 14 is held in the directed orientation as shown in FIG. 4, the thumb and hand of the operator will be spaced away from the antenna 22. Alternatively or additionally, the antenna 22 may be located, for example on the left and/or right lateral side 30, 32 of the interface portion 24, proximate the front end 34. As can be seen in FIG. 4, positioning the antenna 22 on the left and/or right lateral side 30, 32 would also result in the antenna 22 being spaced away from a hand holding the fob 14 in the directed orientation.

Figure 5:
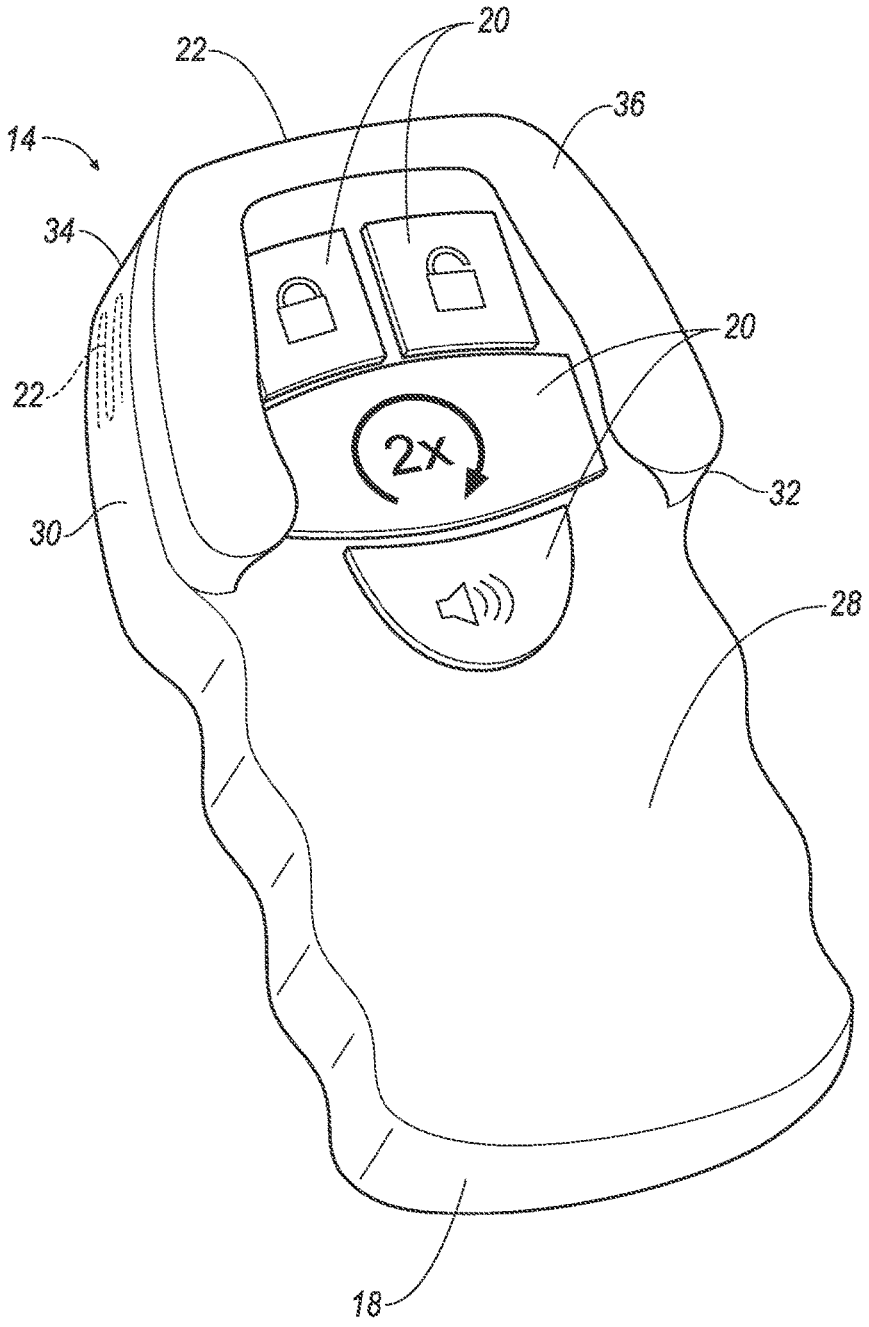
FIG. 5 is a perspective view of an example fob of FIG. 1, including positioning elements for directing a position of a hand holding the fob.

The ridge 36 on the fob 14 may have other shapes. As one additional example and as shown in FIG. 5, the ridge 36 may be a continuous structure extending along the left lateral side 30, across the front end 34, and further along the right lateral side 32. Extending the ridge 36 across the front end 34 may further limit extension of the thumb of the operator of the fob 14 towards the front end 34 of the fob 14. When the fob 14 is held in the directed orientation, the thumb and hand of the operator will be spaced away from an antenna 22 located in the front end 34 of the fob 14. As above, the antenna 22 may further be placed on the left and/or right lateral sides 30, 32 and be spaced away from a hand holding the fob 14 in the directed orientation.

Figure 6:
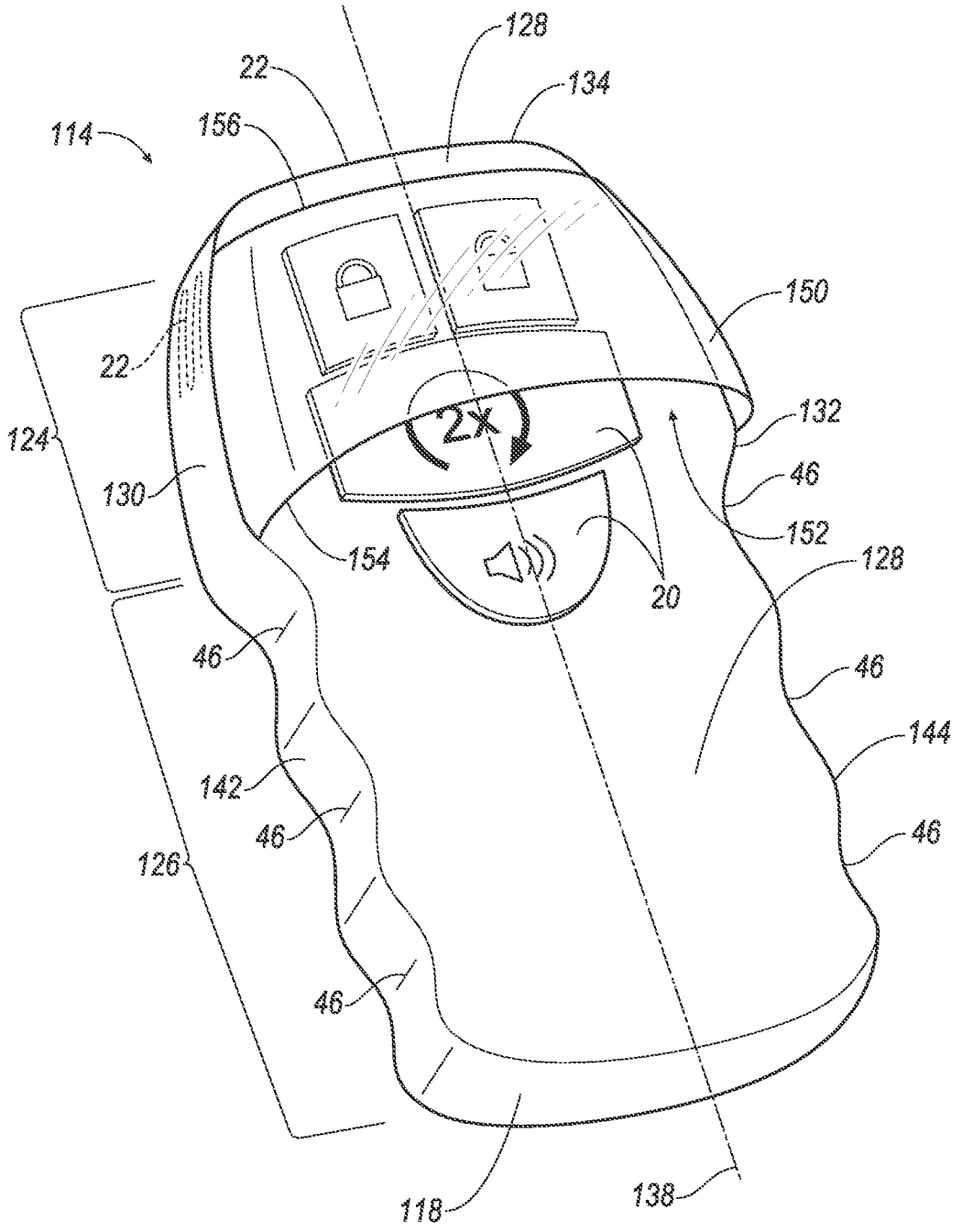
FIG. 6 is a perspective view of an example fob for the system of FIG. 1, including positioning elements for directing a position of a hand holding the fob.

Another example of a fob 114 is shown in FIG. 6. The fob 114 has a case 118 having a top surface 128 and a bottom surface 148. The case 118 includes an interface portion 124 and a handle portion 126. The handle portion 126 is substantially the same as the handle portion 26 of fob 14 as described above.

The interface portion 124 includes a left lateral side 130, a right lateral side 132 and a front end 134. As described above with respect to the fob 14, the fob 114 may have at least one antenna 22. The at least one antenna 22 may be a component included in the electronic module, and enclosed in the case 118. Additionally or alternatively, the antenna 22 may be a wire embedded within, e.g., the left lateral side 130, the right lateral side 132, and/or the front end 134. In order to reduce radio frequency coupling between the antenna 22 and a hand operating the fob 114, the antenna 22 may be located in a position spaced away from the handle portion 126 of the fob 114.

Similar to the fob 14, the fob 114 includes one or more input devices 20 disposed on the top surface 128. The input devices 20 may be buttons, a touch screen display, a gesture sensing device, etc., for receiving input from an operator.

The interface portion 124 of the example fob 114 includes a hood 150 extending from the left lateral side 130 to the right lateral side 132. The hood 150 defines a cavity 152 with a top surface 128 of the fob 114. The hood 150 has a back edge 154 and a front end edge 156. As shown in FIG. 6, the hood 150 may arch over at least a portion of the fob 114 at, e.g., the back edge 154 such that a thumb fits in the cavity 152. The front edge 156 of the hood 150 similarly arches over the fob 114. The hood 150 may be tapered from the back edge 154 to the front edge 156 such that a height of the back edge 154 is greater than a height of the front edge 156 to prevent a user's thumb from extending through a space between the front end edge 156 and the top surface 128. Alternatively, all or portions of the front edge 156 may be attached to the top surface 128 so that the cavity 152 is closed or partially closed at a front end of the hood 150.

The hood 150 may be made of a clear plastic or other transparent material and attached to the fob 114 so that an operator can see the input device 20. Additionally or alternatively, the hood 150 may be formed as a unitary structure with the case 118 or a section of the case 118.

Figure 7:
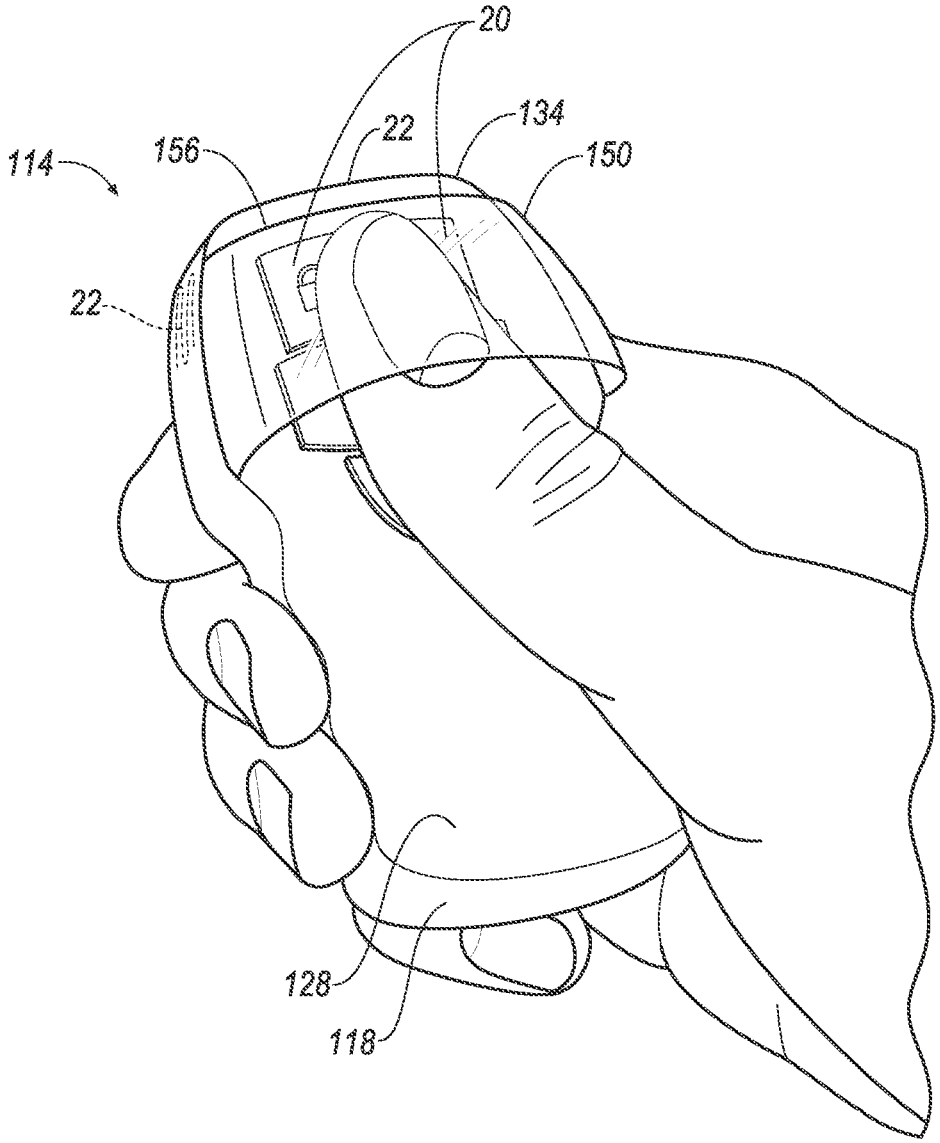
FIG. 7 is a perspective view of a hand holding the fob of FIG. 6.

FIG. 7 illustrates the example fob 114 of FIG. 6, being held in a directed orientation. The fingers are directed to hold the fob 114 at the handle portion 126 by the finger positioners 46. The index finger of the hand is directed to the finger slot 47 on the bottom surface 48 (as shown in FIG. 3D with regard to the fob 14).

The hood 150 also directs the operator to hold the fob 114 in the directed orientation. The hood 150 prevents accessing the input device 20, e.g., buttons, from the left or right lateral sides 130, 132, and also from the front end 134. The shape and position of the hood 150 directs access to the input device 20 by a thumb extending from the handle portion 26 towards the interface portion 124.

Figure 8A:
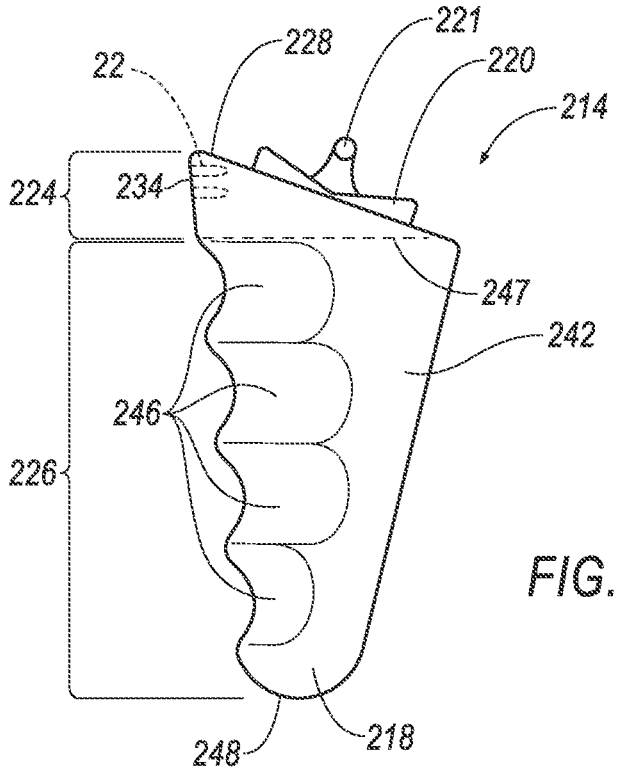
FIG. 8A is a side view of an example fob for the system of FIG. 1, including positioning elements for directing a position of a hand holding the fob.
Figure 8B:
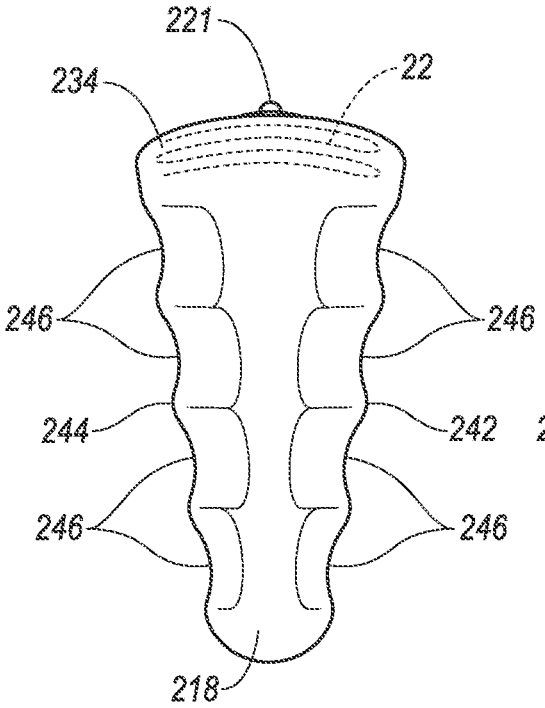
FIG. 8B is a front end view of the fob of FIG. 8A.
Figure 8C:
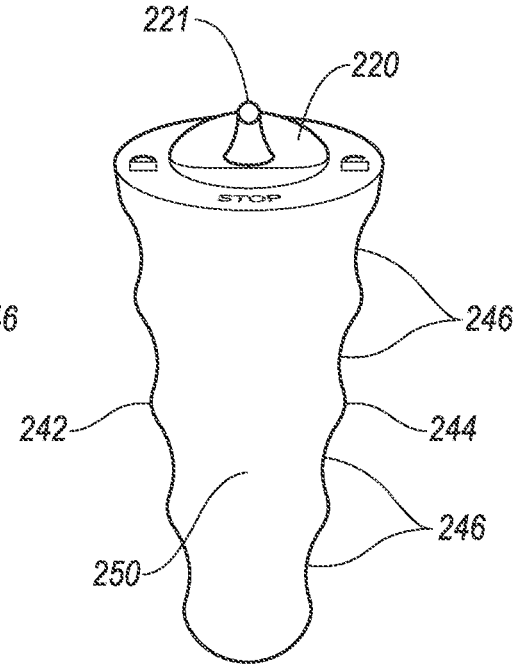
FIG. 8C is a back view of the fob of FIG. 8A.

A third example of a fob 214 is shown in FIGS. 8A-8C. The fob 214 includes a case 218. The case may form an internal cavity enclosing an electronic module (not shown) for facilitating radio frequency (RF) communications. The fob 214 may have an interface portion 224 and a handle portion 226. The fob 214 includes at least one hand positioning element to direct an orientation of a hand holding the fob 214 during operation.

The interface portion 224 may have a flat top surface 228, with an input device 220 disposed on the top portion 228. The input device 220 may be, for example, a four position rocker and push switch and may include a thumb lever 221 extending, in one orientation, upward from a center of the rocker switch. The interface portion 224 may have a front end 234 and may have at least one antenna 22 disposed on the interface portion 224. The antenna may be a component included in the electronic module and/or disposed near the top surface 228, e.g., proximate the front end 234. The antenna 22 may be substantially the same as antenna 22 described with regard to the fob 14.

The handle portion 226 may extend from a side of the interface portion 224 opposite the top surface 228, and may be tapered such that a top end 247 of the handle portion 226 proximate the top surface 228 is wider and longer than a distal bottom end 248. The handle portion 226 has left and right sides 242, 244 and may include at least one finger positioner 246. The at least one finger positioner 246 may be, e.g., grooves formed in the left and right sides 242, 244.

Figure 9:
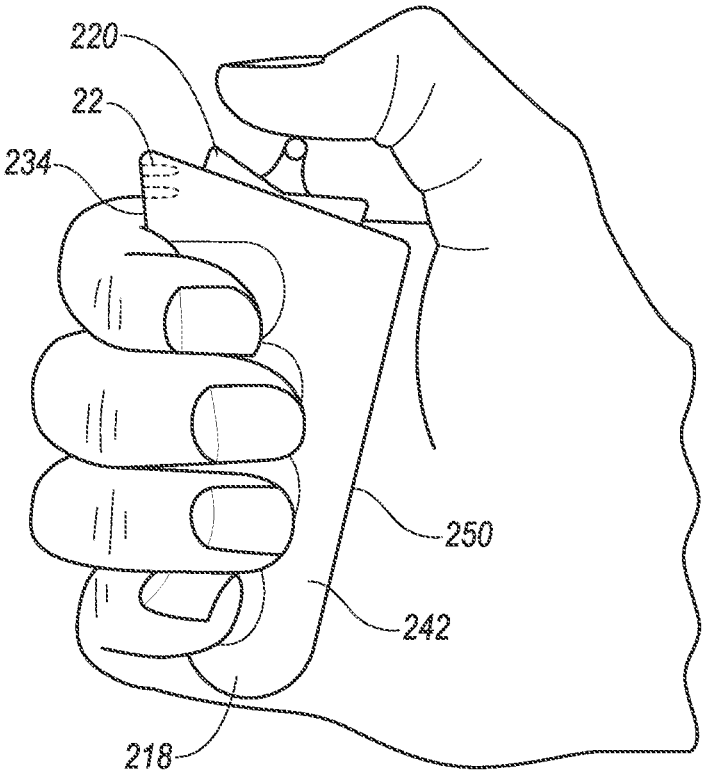
FIG. 9 is a side view of a hand holding the fob of FIG. 8A.

As shown in FIG. 9, the tapered shape of the handle portion 226, the at least one finger positioner 246, and the disposition of the input device 220 on the top surface 228 of the interface portion 224, direct a hand to operate the fob 214 in a directed orientation. In the directed orientation, the handle portion 226 is nestled in the palm of the hand, the fingers curve around the handle portion 226 aligned with the finger positioners 246. A thumb of the hand extends from the hand at a back 250 of the fob 214 towards the front end 234 of the fob 214.

As discussed above, the one or more antennas 22 may be disposed proximate the front end 234 of the interface portion 224 and further proximate the top surface 228. In this configuration, the one or more antennas 22 are spaced away from a hand holding the fob 214 in the directed orientation.

In the drawings, the same reference numbers indicate the same elements. Further, some or all of these elements could be changed. Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

The invention claimed is:

1. A fob comprising:

a case having an interface portion at a first end and a handle portion at a second end;

an antenna disposed on the interface portion of the case spaced from the handle portion;

at least one input device disposed on the interface portion of the case; and at least one hand positioning element for orientating a user's hand on the handle portion of the case away from the antenna, wherein the interface portion includes a first lateral side and a second lateral side, and the at least one positioning element includes a first and second ridge arranged respectively along first and second lateral sides of the interface portion and extending above a first surface of the interface portion.

2. The fob of claim 1, wherein the at least one antenna is disposed on a surface of the interface portion.

3. The fob of claim 1, wherein the handle portion is spaced from a first end of the interface portion.

4. The fob of claim 3, wherein the at least one antenna is disposed in the first end of the interface portion.

5. The fob of claim 1, wherein the at least one positioning element includes at least one finger positioner disposed on the handle portion.

6. The fob of claim 5, wherein the handle portion has first and second lateral sides, and the at least one finger positioner includes a first finger position defining first and second rounded grooves formed respectively in each of the first and second lateral sides.

7. The fob of claim 6, wherein the at least one finger positioner further includes a second finger positioner defining third and fourth rounded grooves respectively in each of the first and second lateral sides, the third and fourth rounded grooves arranged adjacently to respectively the first and second rounded grooves.

8. The fob of claim 1, wherein the first and second ridges are integrally formed with the case.

9. The fob of claim 1, wherein the at least one positioning element includes a ridge extending above the first surface and arranged across a first end of the interface portion opposite the handle portion between the first and second ridges.

10. The fob of claim 1, wherein the antenna is disposed proximate the first surface of the interface portion and the handle portion extends from the interface portion, wherein the handle portion is spaced from the antenna.

11. The fob of claim 10, wherein the antenna is further disposed near a first end of the interface portion.

12. The fob of claim 10, wherein the handle portion is tapered.

13. The fob of claim 1, wherein the at least one input device includes a plurality of buttons.

14. The fob of claim 1, wherein the at least one input device includes a rocker and push button.

15. A fob comprising:

a case having an interface portion at a first end and a handle portion at a second end;

an antenna disposed on the interface portion of the case spaced from the handle portion;

at least one input device disposed on the interface portion of the case; and at least one hand positioning element for orientating a user's hand on the handle portion of the case away from the antenna, wherein the at least one positioning element includes a hood extending at least partially over the interface portion and forming a cavity between the hood and a first surface of the interface portion.

16. The fob of claim 15, wherein the hood includes a barrier that directionally limits access to the interface portion.

17. The fob of claim 15, wherein the hood is integrally formed with the case.

18. The fob of claim 15, wherein the hood is transparent.

19. A fob comprising:

a case having an interface portion at a first end and a handle portion at a second end;

an antenna disposed on the interface portion of the case spaced from the handle portion;

at least one input device disposed on the interface portion of the case; and means for orientating a user's hand on the handle portion of the case away from the antenna, wherein the interface portion includes a first lateral side and a second lateral side, and the at least one positioning element includes a first and second ridge arranged respectively along first and second lateral sides of the interface portion and extending above a first surface of the interface portion.

* * * * *